US006294216B1

(12) United States Patent
Ikezaki et al.

(10) Patent No.: US 6,294,216 B1
(45) Date of Patent: Sep. 25, 2001

(54) VIBRATING METHOD FOR CHARGING POWDER

(75) Inventors: Kazuo Ikezaki; Masahiro Yamamoto, both of Tokyo (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 0 days.

(21) Appl. No.: 09/404,364

(22) Filed: Sep. 24, 1999

(30) Foreign Application Priority Data

Sep. 25, 1998 (JP) ..... 10-271141

(51) Int. Cl.[7] ..... B05D 1/04; B05D 1/22

(52) U.S. Cl. ..... 427/8; 427/459; 427/475; 427/485

(58) Field of Search ..... 427/8, 459, 460, 427/475, 477, 479, 485; 118/634, 688, 627, 629; 361/225–227

(56) References Cited

U.S. PATENT DOCUMENTS 4,597,534 * 7/1986 Roud .

5,753,302 * 5/1998 Sun et al. .

OTHER PUBLICATIONS

"Powder Coatings", Ed by Nicholas P. Liberto, pp. 82–85, 1994.*

* cited by examiner

*Primary Examiner*—Fred J. Parker
(74) *Attorney, Agent, or Firm*—Wenderoth, Lind & Ponack, L.L.P.

(57) ABSTRACT

In a powder charging apparatus according to the present invention, powder is delivered to a delivery tube using delivery air, and an external drive voltage is applied to a vibrator to vibrate the surface of the vibrator. The powder is dispersed around the vibrator when the powder passes through an enlarged diameter portion, and the powder is subjected to vibration from the surface of the vibrator. Thus, each powder particle passes through the enlarged diameter portion while repeatedly colliding against the surface of the vibrator and the inner wall surface of the enlarged diameter portion, which are electrification members. At this time, the surface of the vibrator and the inner wall surface of the enlarged diameter portion charge the powder particles by contact.

6 Claims, 6 Drawing Sheets

VIBRATING METHOD FOR CHARGING POWDER

BACKGROUND OF THE INVENTION

1. Field of the Invention

The present invention relates to an apparatus and a method for charging powder by utilizing frictional electrification. Also, the present invention relates to a powder coating apparatus, and a method of using such a powder charging apparatus in such a powder coating apparatus.

2. Description of the Related Art

An electrostatic power coating method is one for coating charged powder onto the surface of an article to be coated by electrostatic forces. In general, a corona electrification or a frictional electrification is utilized in a method for charging the powder. The corona electrification is excellent in controllability of an electrification rate and an electrification charge amount. Accordingly, a large charge amount can be given to the powder for a short period of time. However, it requires a high voltage and suffers from a problem that the apparatus therefor becomes large and expensive. On the other hand, since the frictional electrification is based upon a contact electrification, it does not require an electric power source. Accordingly, the powder may be charged in a less expensive manner and in a safe manner with a simple apparatus.

However, the frictional electrification suffers from a problem that the charging rate is low and it takes a long time to obtain a predetermined charge amount.

SUMMARY OF THE INVENTION

Accordingly, an object of the present invention is to provide a powder charging apparatus and a method therefor which may charge powder at a high charging rate while utilizing a frictional electrification.

Also, an object of the present invention is to provide a powder coating apparatus, and a method of using such a powder charging apparatus in such a powder coating apparatus.

According to the present invention, there is provided a powder charging apparatus comprising: a delivery tube for delivering powder; an electrification member disposed in the delivery tube; and a vibrating means for imparting at least one of a vibration to the powder and the electrification member to be delivered within the delivery tube to accelerate a contact between the powder and the electrification member.

A vibrator disposed in the delivery tube may be used as the vibrating means. An inner wall surface of the delivery tube and the surface of the vibrator may be used as electrification members. A TEFLON, i.e., polytetrafluoroethylene, coating layer may be formed on the inner wall surface of the delivery tube and the surface of the vibrator.

It is possible to take a structure in which a metal mesh having a mesh size through which the powder may pass is provided across an interior of the delivery tube, and a number of carriers which have a size by which the electrification member cannot pass through the size of the metal mesh and which may be trapped within the delivery tube by the metal mesh are used as the electrification members. The vibrator may be mounted on the metal mesh as the vibrating means.

Furthermore, the electrification member may be disposed within the delivery tube for feeding a predetermined amount of the powder and the electrification member is a screw to be driven by a driving means. The vibrating means may vibrate the screw.

A charge amount detecting means for detecting a charge amount of the powder and a controller for controlling an amplitude and/or a frequency of the vibration by the vibrating means so that the charge amount to be detected by the charge amount detecting means is kept at a predetermined value may be provided. In this case, a feed unit for feeding the powder through the delivery tube may be provided, and the controller controls the vibrating means so that the charge amount per unit weight of the powder is kept at a predetermined value on the basis of the feed amount of the feed unit and the charge amount detected by the charge amount detecting means.

A powder charging method in accordance with the present invention is a method of vibrating the powder delivered within a delivery tube, and/or the electrification member disposed within the delivery tube, to thereby accelerate the contact between the powder and the electrification member. Furthermore, it is possible to detect a charge amount of the powder and to control an amplitude and/or a frequency of the vibration so that the detected charge amount is kept at a predetermined value. Also, it is possible to control the amplitude, and/or the frequency, of the vibration on the basis of a feed amount and the charge amount of the powder so that the charge amount per unit weight of the powder is kept at a predetermined value.

A powder coating apparatus according to the present invention is provided with a spray unit for spraying an article to be coated with the powder charged by the above-described powder charging apparatus according to the invention.

Alternatively, the powder coating apparatus is provided with a booth where an article to be coated is held, a fluidizing layer of the coating powder formed on a bottom portion of the booth with a top side of the fluidizing layer being opened, and a spraying apparatus for extracting the coating powder from the fluidizing layer and spraying the coating powder into the booth from a top portion of the booth after charging the coating powder by the above-described powder charging apparatus according to the invention. In this case, it is possible to provide an electric field forming means for forming an electric field for sticking the coating power sprayed into the booth to the article to be coated or a feeding air forming means for feeding a pressurized air for depressing the coating powder sprayed into the booth toward the article to be coated.

A powder coating method according to the invention is a method wherein the powder charged in accordance with the powder charging method of the invention is sprayed to the article to be coated.

Alternatively, it is possible to fluidize coating powder on a bottom portion of a booth, extract the fluidized coating powder and spray the coating powder into the booth from a top portion of the booth after charging the coating powder in accordance with the powder charging method of the invention and introduce an article to be coated in the booth. In this case, it is possible to form an electric field for introducing the coating powder to, and around, the article to be coated, or to feed pressurized air for depressing the coating powder toward the article to be coated.

DESCRIPTION OF THE PREFERRED EMBODIMENTS

In the case where an article to be charged is powder such as coating powder, in order to charge each powder particle with a large charge amount by a frictional electrification, it is insufficient to bring a part of the powder group into contact with an electrification member and it is necessary to bring each powder particle in the powder group into contact with the electrification member. Furthermore, in order to enhance the charging rate of each powder particle, it is necessary to increase an effective contact area between each powder particle and the electrification member per unit time. For this reason, it is inevitable to realize a relative movement between each powder particle and the electrification member at a high speed and to bring each powder particle into contact with the electrification member many times.

As a result of vigorous studies, the present inventors have found that a method for utilizing vibrations of frequency regions including a supersonic wave region is effective for charging the powder.

Figure 1A:
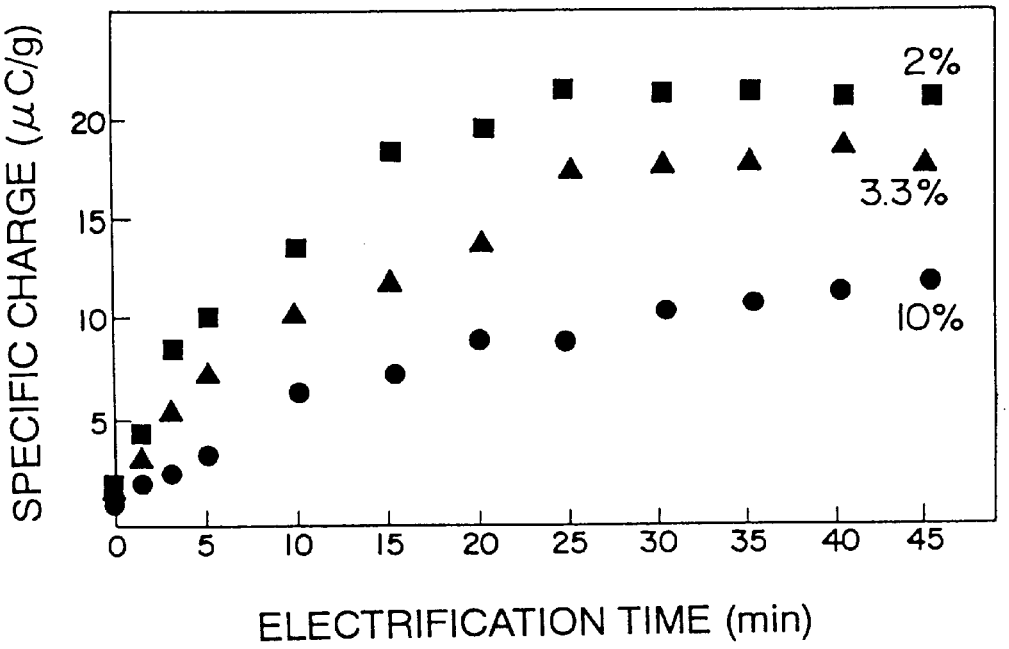
FIGS. 1A and 1B are graphs showing a result of an experiment, in which a specific charge of powder was measured relative to an electrification time when the coating powder was mixed with a ferrite carrier and rotated in the case where a supersonic wave vibration was not used, and in the case where a supersonic wave vibration was used together, respectively.
Figure 1B:
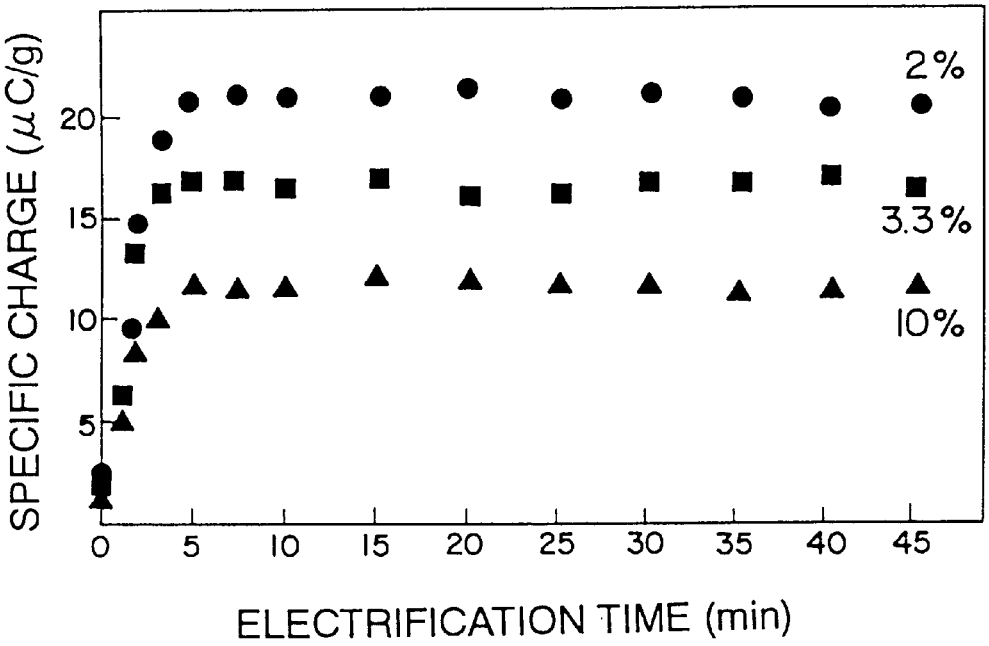

Here, the following experiment was conducted concerning the effect of the vibrations on the charge of the powder. Coating powder used in electrostatic powder coating was mixed with a ferrite carrier, and the mixture was filled into a plastic cylindrical container. This cylindrical container was laid on a roller for a small-size ball milling machine and rotated at 60 rpm. A lapse of time from the start of rotation was assumed as a charging time, and a charge amount of the coating powder relative to this charging time was measured by an absorption type Faraday gauge. The measurement result is shown in FIGS. 1A and 1B. The mixture ration between the coating powder and the ferrite carrier was represented by three kinds of percentages of 10%, 3.3%, and 2% by weight. The charge amount of the coating powder was represented by a specific charge ($\mu$C/g). FIG. 1A shows the condition that the cylindrical container was simply rotated on the roller in the atmosphere. On the other hand, FIG. 1B shows the condition that the cylindrical container was sunk in a supersonic wave cleaning bath at a frequency of 45 kHz and rotated on the roller so that the supersonic wave vibration was added to the rotation.

As shown in FIG. 1A, when the vibration was not applied, the time until the charge amount (specific charge) reached the saturation was about 25 min, even in the case where the mixture ratio with the ferrite carrier was low (2% or 3.3%) and 45 min or more in the case where the mixture ratio was high (10%). In contrast, in the case where the supersonic wave vibration was applied, as shown in FIG. 1B, the saturation was obtained in about 5 to 7 min. It is understood that the charging rate was improved by 5 times or more by utilizing the supersonic wave vibration.

The Embodiments of the present invention will now be described with reference to the accompanying drawings.

Embodiment 1

Figure 2:
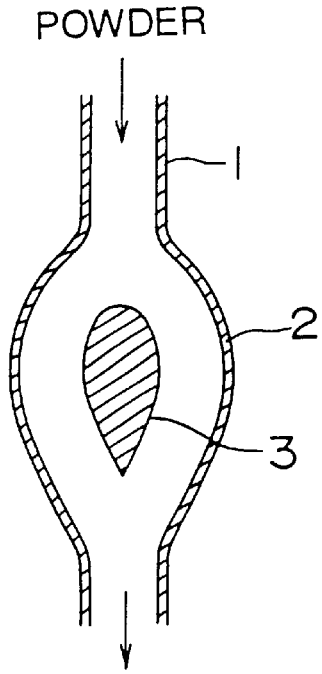
FIGS. 2 to 5 are cross-sectional views of a powder charging apparatus in accordance with Embodiments 1 to 4, respectively.

A powder charging apparatus in accordance with Embodiment 1 of the present invention is shown in FIG. 2. An enlarged diameter portion 2, where the diameter is enlarged relative to the other portions, is formed in a delivery tube 1 for delivering powder. A vibrator 3 is disposed in a central inner portion of the enlarged diameter portion 2. The vibrator 3 is formed of, for example, a piezoelectric element and the surface of the vibrator 3 vibrates at a desired frequency by applying an external, periodically changing, drive voltage to the vibrator 3.

For instance, when the surface of the vibrator 3 is vibrated by applying the drive voltage to the vibrator 3 from the outside while delivering the powder in a direction indicated by the arrows within the delivery tube 1 by using delivery air, the powder is dispersed to the marginal portion of the vibrator 3 by the vibrator 3 when the powder passes through the enlarged diameter portion 2 and is subjected to vibrations from the surface of the vibrator 3. Thus, each powder particle passes through the enlarged diameter portion 2 while repeatedly colliding against the inner wall surface of the enlarged diameter portion 2 and the surface of the vibrator 3 which are electrification members. At this time, the powder is charged by the contact with the surface of the vibrator 3 or the inner wall surface of the enlarged diameter portion 2.

Embodiment 2

Figure 3:
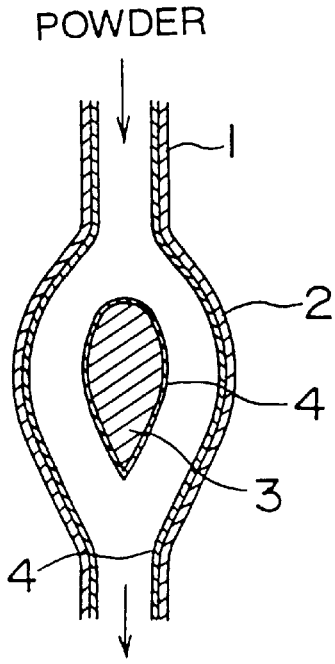

A powder charging apparatus according to Embodiment 2 is shown in FIG. 3 in which coating layers 4 of TEFLON, or the like, are applied to the surface of the vibrator 3 and the inner wall surface of the enlarged diameter portion 2, which are the electrification members, of the powder charging apparatus according to Embodiment 1. The charge amount of the powder obtained by one contact is increased by the coating layers 4, thereby further enhancing the charging rate.

Embodiment 3

Figure 4:
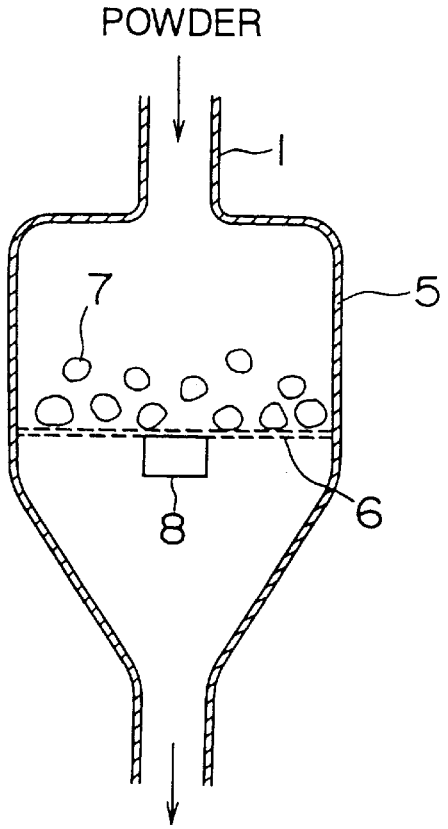

A powder charging apparatus according to Embodiment 3 is shown in FIG. 4. An enlarged diameter portion 5 is formed in a delivery tube 1. A metal mesh 6 having a mesh size through which the powder may pass is provided across the enlarged diameter portion 5. A number of ferrite carriers 7 which are electrification members are received in the enlarged diameter portion 5 upstream of the metal mesh 6. Each ferrite carrier 7 has a size which prevents the carrier from passing through the metal mesh 6 and is trapped by the metal mesh 6. Also, a vibrator 8 which serves as a vibrating means is mounted on the metal mesh 6.

The metal mesh 6, and hence the ferrite carrier 7, are vibrated by the vibrator 8. The powder which has been fed into the enlarged diameter portion 5 is repeatedly brought into contact with a number offerrite carriers 7 while being charged before flowing downstream within the delivery tube 1 through the metal mesh 6.

Embodiment 4

Figure 5:
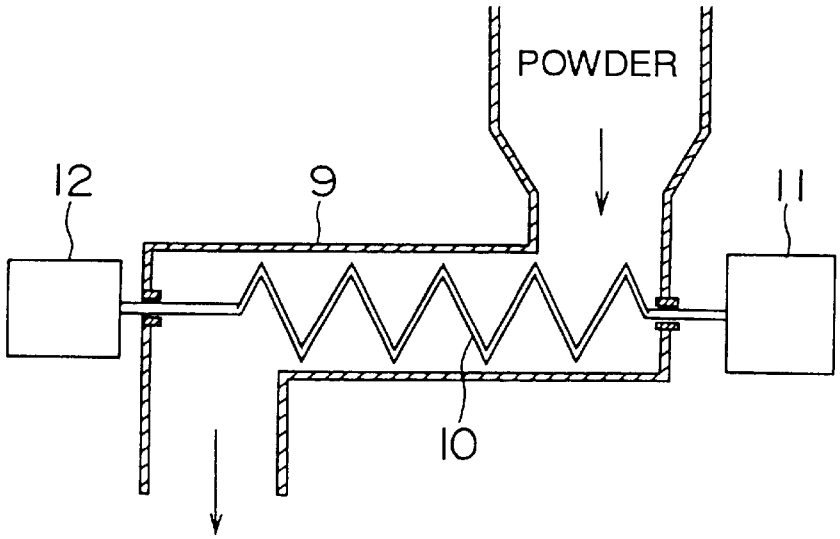

A powder charging apparatus according to Embodiment 4 is shown in FIG. 5. A screw conveyor is provided as a feeding means for feeding the predetermined amount of powder. The screw conveyor is provided with a screw 10 disposed within the delivery tube 9 and a motor 11 serving as a drive means for rotating the screw 10. A vibrator 12 for vibrating the screw 10 is connected to the screw 10.

When the vibrator 12 vibrates the screw 10 while the motor 11 rotates the screw 10, a predetermined amount of the powder to be charged is delivered within the delivery tube 9 by the rotation of the screw 10, and at the same time brought into contact with the surface of the screw 10. Namely, it is possible to feed a predetermined amount of the powder, while charging the powder. Incidentally, if a coating layer such as TEFLON, or the like, is formed on the surface of the screw 10, it is possible to further enhance the charging efficiency.

Embodiment 5

Figure 6:
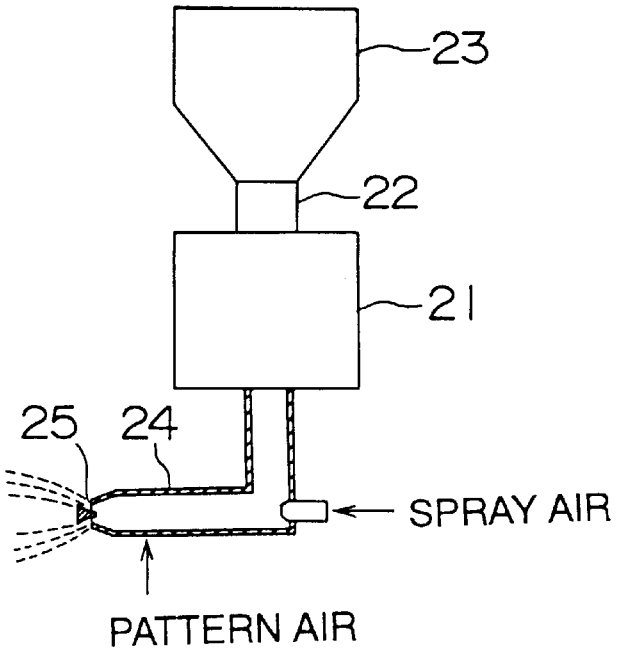
FIGS. 6 to 8 are block diagrams showing a powder coating apparatus in accordance with Embodiments 5 to 7, respectively.

A powder charging apparatus according to Embodiment 5 is shown in FIG. 6. A coating material tank 23 for receiving coating powder is connected through a feeding unit 22 on the upstream side of a delivery tube of a powder charging device 21 in accordance with any one of the above-described Embodiments 1 to 3. A spray unit 24 for spraying the charged coating powder to the articles to be coated is connected on the downstream side of the delivery tube of the powder charging device 21. A spray air for blowing the coating powder out from a tip end nozzle 25 and a pattern air for causing the spray pattern of the coating powder into a desired pattern are fed to the spray unit 24.

The coating powder to be fed from the coating material tank 23 by the feeding unit 22 is charged by frictional electrification together with the vibrations by the powder charging unit 21. Thereafter, the coating powder is fed into the spray unit 24 and is blown out toward the articles to be coated from the tip end nozzle 25 with the desired pattern. Since the coating powder is charged by the powder charging unit 21 and then fed into the spray unit 24, it is unnecessary to provide a means for charging the coating powder to the spray unit 24 thereby simplifying the structure of the spray unit 24.

Since vibrations are applied to the powder for charging in the powder charging unit 21, the movement speed of each powder particle is increased and the coagulation of the powder is prevented. It is possible to perform the spray of the powder with a small amount of spray air. For this reason, it is possible to prevent the sprayed powder that is blown out at a high speed by the pressurized air, from not sticking to the articles to be coated. It is therefore possible to effectively form the coating layer.

Incidentally, as in the powder charging apparatus in accordance with the Embodiment 4 shown in FIG. 5, if the apparatus for feeding the predetermined amount of powder while charging the powder is used, it is sufficient to connect such a power charging apparatus to the coating material tank 23 and further connect the spray unit 24 to the power charging apparatus.

Embodiment 6

Figure 7:
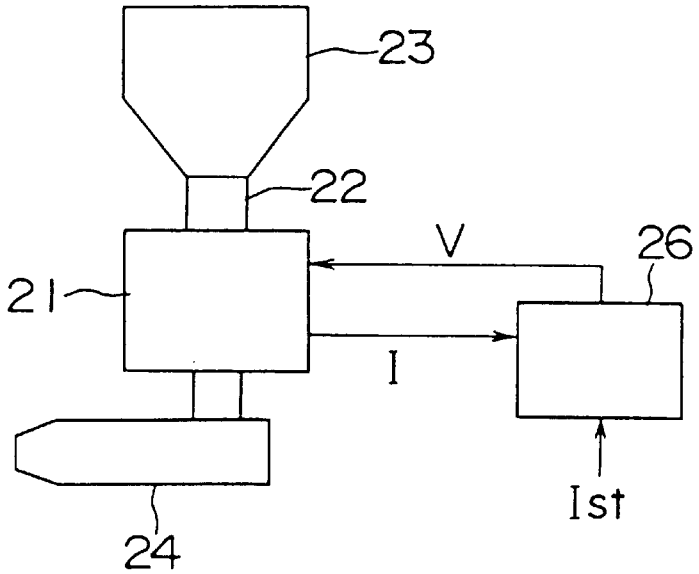

A powder charging apparatus according to Embodiment 6 is shown in FIG. 7. A controller 26 is connected to the powder charging unit 21 in the above-described coating apparatus in accordance with the Embodiment 5. An end of a leading line (not shown) is connected to the electrification member within the powder charging unit 21 and the other end is connected to the controller 26. When the reception and release if the charge between the powder and the electrification member is performed by the contact therebetween, a current I corresponding to the movement amount of the charge per unit time is caused to flow through the leading line to the controller 26. The controller 26 is set so that a current having a target value Ist is externally inputted into the controller 26, or the target value Ist is set within the controller 26 in advance. The controller 26 applies the drive voltage V, which causes the value of the current I inputted from the powder charging unit 21 to be the target value Ist to the vibrator within the powder charging 21. Thus, the amplitude and/or frequency of the vibration of the vibrator is controlled.

With such a structure, it is possible to suppress the variation in charge amount caused by the difference of the material of the powder and the variation in powder viscosity, humidity, and the like, and to keep the electrification amount constant to realize a uniform film thickness while stabilizing the coating efficiency.

Embodiment 7

Figure 8:
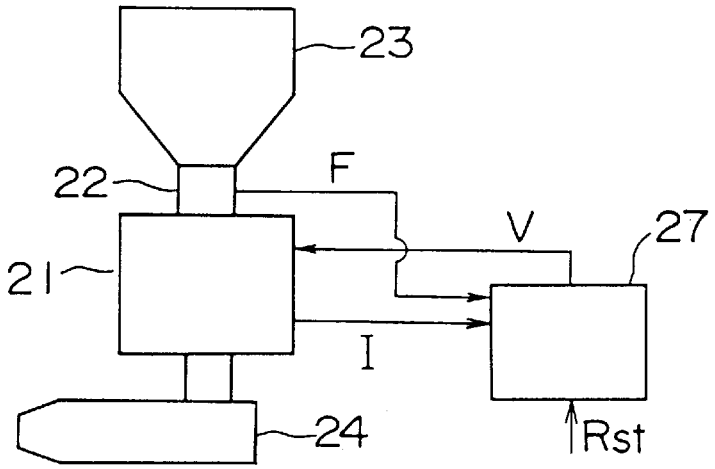

A powder charging apparatus according to Embodiment 7 is shown in FIG. 8. A feed amount F of the powder per unit time from the feeding unit 22 is inputted into a controller 27 in the powder coating apparatus according to the above-described Embodiment 6. Also, a target value Rst of the specific charge is inputted from the outside to the controller 27, or the target value Rst is set within the controller 27 in advance.

When the coating powder is fed from the coating material tank 23 through the powder charging unit 21 to the spray unit 24 by the feeding unit 22, the feed amount F of the powder is inputted from the feeding unit 22 to the controller 27. When the reception and release of the charge between the powder and the electrification member is performed within the powder charging unit 21, the current I is caused to flow through the leading line to the controller 27 in response to the movement amount of the charge per unit time. The controller 27 calculates the specific charge R=I/F on the basis of the value of the current I inputted from the powder charging unit 21, and the feed amount F inputted from the feeding unit 22 to obtain the drive voltage V, such that the specific charge R, which is the target value Rst, is applied to the vibrator within the powder charging unit 21, thereby controlling the amplitude and/or the frequency of the vibration of the vibrator.

With such a structure, it is possible not only to suppress the variation in charge amount caused by the difference of the material of the powder and the variation in powder viscosity, humidity, and the like, as in the Embodiment 6, but also to keep the electrification amount constant even if the feed amount of the coating powder is changed.

Embodiment 8

Figure 9:
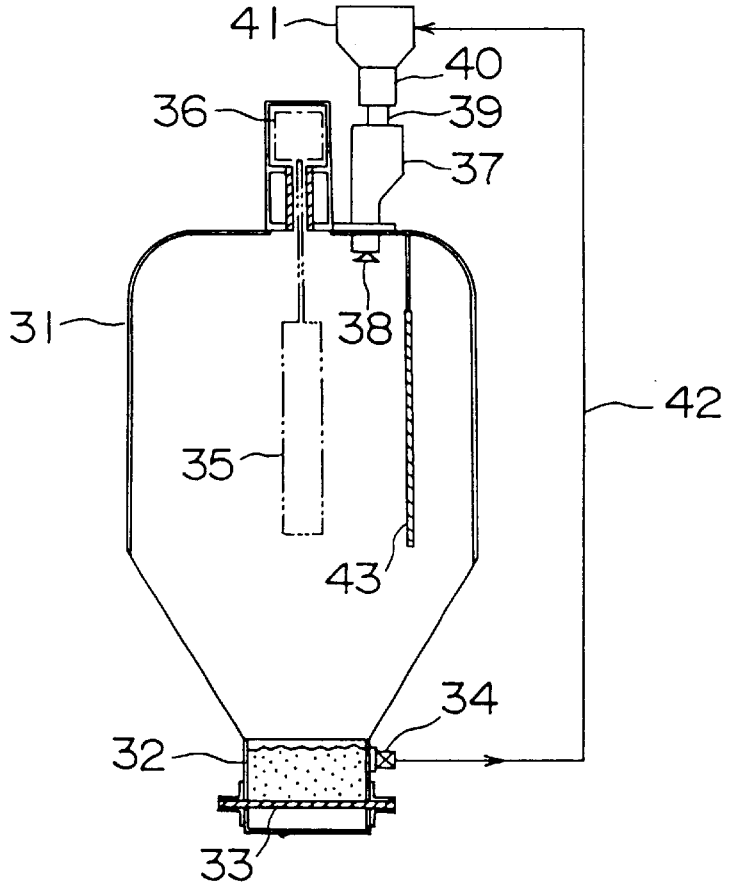
FIGS. 9 to 11 are cross-sectional views showing a powder coating apparatus in accordance with Embodiments 8 to 10, respectively

A powder charging apparatus according to Embodiment 8 is shown in FIG. 9. A fluidizing layer unit 32 for fluidizing the coating powder is detachably mounted on a bottom portion of a booth 31. An interior of the fluidizing layer unit 32 is in communication with the booth 31 with its upper portion being opened. Fluidizing layer unit 32 is divided into an upper chamber and a lower chamber by a porous plate 33. Pressurized air is fed through an air inlet port (not shown) to the lower chamber. An injector 34 is mounted on a side wall of the upper chamber.

A conveyer 36, for delivering the article 35 to be coated through the booth 31 and hanging the article in the booth 31, is disposed on the booth 31 in the lengthwise direction. A coating material spray nozzle 38 of a spray unit 37 is mounted on a ceiling surface of the booth 31 in a downward direction. A powder charging unit 39, a feeding unit 40, and a coating material tank 41 according to the present invention are connected in order with the spray unit 37. The injector 34 of the fluidizing layer unit 32 is connected through a coating material hose 42 to the coating material tank 41. An electrode plate 43 is suspended in the longitudinal direction of the booth 31 from the upper portion of the interior of the booth 31. A high voltage power source (not shown) is electrically connected to the electrode plate 43.

When the pressurized air is fed into the lower chamber of the fluidizing layer unit 32, the coating powder is injected through the porous plate 33 into the upper chamber where the coating powder is received and the coating powder is fluidized. Then, when the pressurized air is fed to the injector 34, the coating powder which has been fluidized within the upper chamber of the fluidizing layer unit 32 is extracted into the coating material hose 42 and fed to the coating material tank 41. A predetermined amount of the coating powder within the coating material tank 41 is fed into the powder charging unit 39 by the feeding unit 40 and charged in the powder charging unit 39. Thereafter, the coating powder is blown out from the coating material spray nozzle 38 of the spray unit 37 to the booth 31 and floatingly drops by the gravitational force to be returned back to the upper chamber of the fluidizing layer unit 32.

In operation, the article 35 to be coated is introduced into the booth 31, which has an ambient atmosphere, by driving the conveyor 36, and at the same time giving a potential to the electrode plate 43 by the high voltage power source (not shown) to form a predetermined electric field between the electrode plate 43 and the surface of the article 35 kept at ground. Thus, the coating powder, which floats within the booth 31, is subjected to the electrostatic force from the electric field, and is stuck onto the surface of the article 35 thereby forming the coating film. electric field between the electrode plate 43 and the surface of the article 35 kept at the ground level. Thus, the coating powder which floats within the booth 31 is subjected to the electrostatic force from the electric field to be stuck onto the surface of the article 35 to form the coating film.

Embodiment 9

Figure 10:
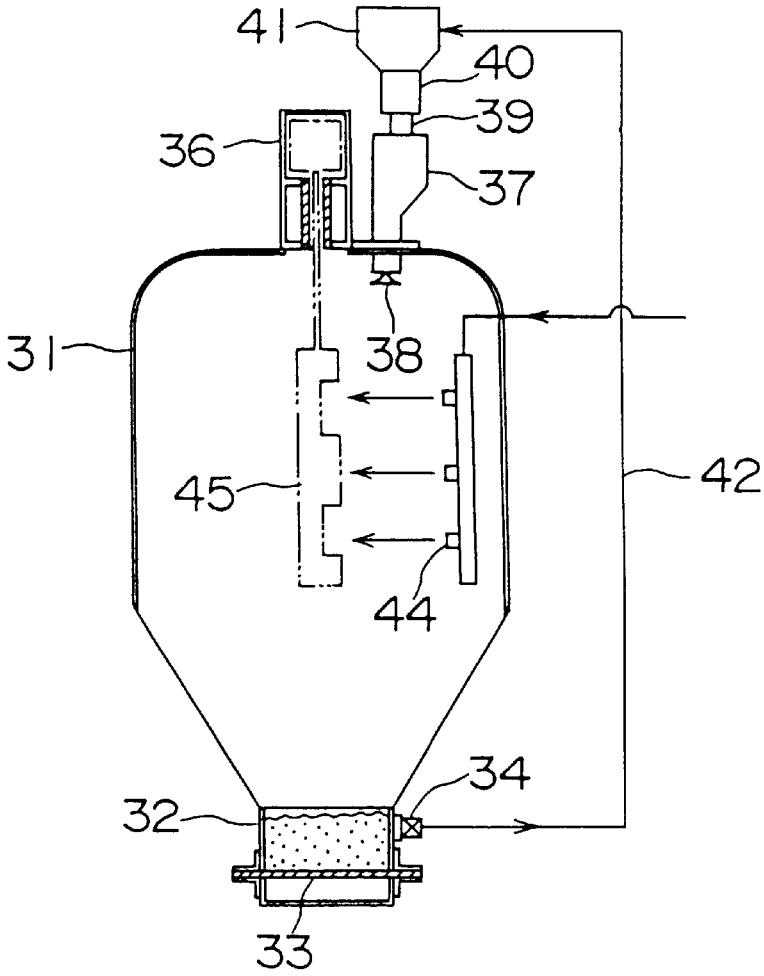

A powder charging apparatus according to Embodiment 9 is shown in FIG. 10. In this power coating apparatus, feeding air nozzles 44 are provided in the booth 31 instead of the electrode plate 43 and the pressurized air is fed toward the article 45 to be coated from the feeding air nozzle 44 in the power coating apparatus in accordance with the Embodiment 8. Thus, by injecting the pressurized air from the feeding air nozzles 44, it is possible to push the coating powder into the recess portions, even if the recess portions are formed on the surface of the article 45 to be coated, to form the coating layer.

Embodiment 10

Figure 11:
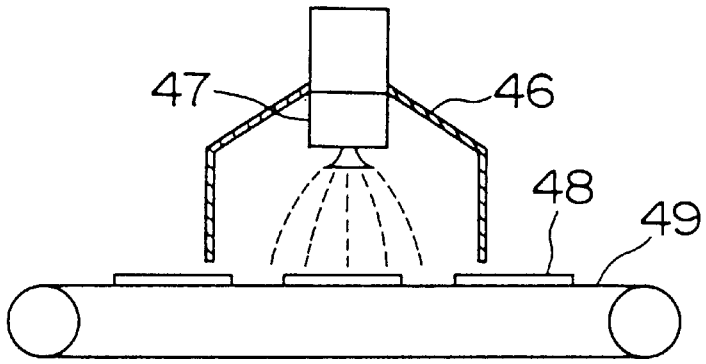

A powder charging apparatus according to Embodiment 10 is shown in FIG. 11. In this powder charging apparatus, the invention is applied to a PCM (precoat metal) unit provided with the powder charging unit shown in the Embodiments 5 to 7. A spray unit 47 provided with the powder charging unit is disposed on an upper portion within a booth 46, and a plurality of articles 48 to be coated are laid on a belt conveyor 49 and introduced into the booth 46 continuously in order. The coating powder sprayed from the spray unit 47 is stuck to the surface of the articles 48.

Since vibrations are utilized for charging the powder, the movement speed of each powder particle is increased and the coagulation of the powder is prevented and it is possible to deliver the powder with less delivery air than that of the conventional system. As a result, it is possible to reduce the discharge air amount from the booth 46.

Incidentally, in the above-described Embodiments 5 to 10, the coating powder to be used for the powder coating by the powder charging unit is charged, but this invention is not limited to the powder coating. It is possible to apply the charged powder in a wide variety of fields. For example, if the invention is applied to a spacer powder to be dispersed between liquid crystal substrates constituting a liquid crystal device, the powder with a constant charge is uniformly dispersed without overlapping. Also, in addition, the invention may be applied to a charger of an electrostatic sorting machine for sorting and refining substances, a charger of an electrostatic size sorter for sorting particles in accordance with a granular size, a charger for toner used in an electronic photography, a charger for dispersing talc for preventing the adhesion of rubber sheets or the like.

As described above, according to the present invention, by accelerating the contact between the powder and the electrification member while giving the vibration to the powder and/or the electrification member, it is possible to charge the powder at a high charging rate while utilizing the frictional charging.

Also, if the powder coating is performed by using the thus charged coating powder, it is possible to save the amount of the delivery air for the coating powder and to prevent the coating powder from not sticking to the article to be coated, to thereby enhance the coating efficiency. Furthermore, it is possible to control the electrification amount of the coating powder and the blow rate thereof, independently of each other.

What is claimed is:

1. A powder charging method in which powder is charged by contact between the powder and an electrification member, said method comprising:
   - delivering powder through a powder delivery tube, said powder delivery tube comprising said electrification member;
   - vibrating the powder delivered within said delivery tube and/or vibrating said electrification member to thereby accelerate contact between the powder and said electrification member to charge the powder;
   - detecting an amount of charge of the charged powder; and
   - controlling the amplitude and/or frequency of vibration so that the detected amount of charge is kept at a first predetermined value.

2. The powder charging method according to claim 1, further comprising controlling the amplitude and/or the frequency of vibration on the basis of a feed amount of powder and the amount of charge of the powder so that the charge amount per unit weight of the powder is kept at a second predetermined value.

3. A powder coating method in which powder is charged by contact between the powder and an electrification member, said method comprising:
   - delivering powder through a powder delivery tube, said powder delivery tube comprising said electrification member;
   - vibrating the powder delivered within said delivery tube and/or vibrating said electrification member to thereby accelerate contact between the powder and said electrification member to charge the powder;
   - detecting an amount of charge of the charged powder;
   - controlling the amplitude and/or frequency of vibration so that the detected amount of charge is kept at a first predetermined value; and spraying said charged powder to an article to be coated.

4. A powder coating method in which powder is charged by contact between the powder and an electrification member, said method comprising:

fluidizing coating powder on a bottom portion of a booth;

extracting the fluidized coating powder;

delivering said extracted coating powder through a powder delivery tube, said powder delivery tube comprising said electrification member;

vibrating the powder delivered within said delivery tube and/or vibrating said electrification member to thereby accelerate contact between the powder and said electrification member to charge the powder;

detecting an amount of charge of the charged powder;

controlling the amplitude and/or frequency of vibration so that the detected amount of charge is kept at a first predetermined value;

introducing an article to be coated into said booth; and spraying the charged coating powder into said booth towards said article from a top portion of said booth.

5. The powder coating method according to claim 4, further comprising forming an electric field for introducing the coating powder to and around the article to be coated.

6. The powder coating method according to claim 4, further comprising feeding pressurized air for blowing the coating powder towards the article to be coated.

* * * * *